US006199480B1

(12) United States Patent
Leonhardt et al.

(10) Patent No.: US 6,199,480 B1
(45) Date of Patent: Mar. 13, 2001

(54) ARRANGEMENT FOR DETERMINING REGISTER DEVIATIONS OF A MULTICOLOR ROTARY PRINTING MACHINE

(75) Inventors: Holger Leonhardt, Bammental; Tobias Müller, Hirschberg, both of (DE)

(73) Assignee: Heideiberger Druckmaschinen, Heideiberg (DE)

( * ) Notice: Subject to any disclaimer, the term of this patent is extended or adjusted under 35 U.S.C. 154(b) by 825 days.

(21) Appl. No.: 08/510,971

(22) Filed: Aug. 3, 1995

Related U.S. Application Data

(63) Continuation-in-part of application No. 08/389,980, filed on Feb. 14, 1995, now abandoned, which is a continuation of application No. 08/073,122, filed on Jun. 7, 1993, now abandoned.

(30) Foreign Application Priority Data

Jun. 6, 1992 (DE) ..... 42 18 760

(51) Int. Cl.[7] ..... B41F 13/24; B41F 5/16; B41F 5/18

(52) U.S. Cl. ..... 101/248; 101/181; 101/183

(58) Field of Search ..... 101/181, 183, 101/248, 481, 485, 486

(56) References Cited

U.S. PATENT DOCUMENTS 3,701,464 * 10/1972 Crum .
4,450,766 * 5/1984 Inomata et al. .
4,546,700 * 10/1985 Kishner et al. .
4,569,584 * 2/1986 St. John et al. .
4,698,514 * 10/1987 Hilmersson et al. .
4,731,542 * 3/1988 Doggett .

FOREIGN PATENT DOCUMENTS

381713 * 10/1964 (CH) .
26 43 481 * 3/1978 (DE) .
26 58 659 * 6/1978 (DE) .
27 31 914 * 1/1979 (DE) .
32 26 078 * 2/1983 (DE) .
40 14 706 * 11/1991 (DE) .
40 14 708 * 12/1991 (DE) .
0 131 241 * 1/1985 (EP) .
1 442 678 * 7/1976 (GB) .
62-68759 * 3/1987 (JP) .

* cited by examiner

*Primary Examiner*—Kimberly Asher

(57) ABSTRACT

An apparatus in a multicolor rotary printing machine for determining register deviations, including a scanning device disposed behind a print gap of a last printing unit of the printing machine; at least one register mark line disposed on printing material movably disposed relative to the scanning device, wherein the scanning device is directed to the register mark line; a control circuit connected with the scanning device for processing signals from the scanning device, and a measuring, steering and regulating device receiving inputs from the control circuit in operative engagement with registers of the printing machine, and a plurality of section reference marks on the printing material, in alignment with the register mark line within scanning range of the scanning device for correcting the register deviations.

10 Claims, 13 Drawing Sheets

ARRANGEMENT FOR DETERMINING REGISTER DEVIATIONS OF A MULTICOLOR ROTARY PRINTING MACHINE

CROSS-REFERENCE TO RELATED APPLICATIONS

This application is a continuation-in-part of application Ser. No. 08/389,980, filed Feb. 14, 1995, now abandoned which was a file-wrapper continuation of Ser. No. 08/073,122, filed Jun. 7, 1993, now abandoned.

BACKGROUND OF THE INVENTION

Field of the Invention

The invention relates to a multicolor rotary printing machine for printing sheets or webs, having on-line register adjustment, or register measuring devices. The invention serves for determining register deviations between different ink colors, especially deviations in regard to circumferential, side and diagonal register, which are to be minimized with register adjusting devices connected with a steering and control device.

The known art includes a stationary installed photo-electric scanning device for register marks, which is connected with a switching device for measuring register mark positions (DE 32 26 078 A1, DE 26 43 481 A1, DE 27 31 914 A1, DE 26 58 659 A1, DE 40 14 706 A1, and DE 40 14 708 A1).

The times between the register signals are evaluated between each other or in response to a reference signal, wherein the time/path relations of position deviations of the register marks can be evaluated. In the known devices, the scanning arrangement is connected with start/stop inputs of a counter circuit, whose counting state is proportional with the timed appearance of reference signals and register mark signals (DE 32 26 078 A1). As reference signal, it is possible to use, for example, a fixed edge on a cylinder transporting the printed material, which is detected by means of a scanning device. The known art has the drawbacks that the velocity of the printing material must be constant, which in practice cannot be assured. The peripheral velocity of a printing cylinder swings back and forth even at a constant printing speed as much as several tenths of a percent, which leads to an impermissibly high error in the measurement of the register marks when the register marks are sensed by the scanning device on the surface of the printing cylinder. The uneven velocity is a result of variations in the load on the printing machine drive since the load during printing is subject to strong variations both in regard to time and in regard location in the machine.

Furthermore, there are known devices by means of which the angular position and velocity of a cylinder transporting printing material can be measured with incremental or absolute angle transmitter (DE 26 58 659 A1, DE 27 31 914 A1).

In that manner, the appearance of the register marks are evaluated in relation to the angular position of the cylinder, and from which the actual deviation of a register mark can be determined on the basis of the sheet length in the form of a nominal value. In that case incremental angle transmitters are used, for generating a specially generated reference or zero pulse, which is used as a reference for the angular position at which the register mark signal appears.

Such angle transmitters for determining register deviation require additional investment, especially since the angle transmitter requires a certain mounting space and must, for the purpose of measurement, be mounted very precisely. Furthermore, the transmission of the measuring signals from the angle transmitter require additional electronic investments in order to assure high validity of the signals in the presence of noise. The measurement of the position of the register mark with angle transmitter is subject to error, since during the printing, especially due to forces caused by the gripper and forces appearing during and after the print slot in the printed material (i.e. the point of contact between superimposed rollers or cylinders or printing cylinders and forms), and at least in subregions a relative movement relating to the surface of the transporting cylinders, which can cause errors in the register signals relating to the angle transmitter signals.

In the European Patent application EP 04 44 583 A2, there is described marks printed on a printing material for determining registration, which include crossing lines visually printed for each print color, and which include a linear and a curved section which are machine-readable. The visual sensing of the register deviations is performed in economical off-line manner by means of an optical register cross reader. The machine sensing is performed by means of a video camera, by means of which scanning signals serve to control register adjusting devices.

The aforesaid method has the drawback that for on-line precise register adjustment the data for machine evaluation must be present in predetermined mutually separate positions on the printed material, which requires a relatively wide section of the printed material for the register marks, and require a photo-electric sensor matched to the register marks, and has a scanning width adjusted to the width of the register marks. Furthermore, this approach does not provide information as to which reference the measurements of the register deviations are related.

SUMMARY OF THE INVENTION

It is accordingly an object of the invention to provide an arrangement for determining register deviations in a multicolor rotary printing machine, which provides a high degree of accuracy, combined with low investment for determining positions of register marks printed on printing material.

The invention includes an arrangement for determining register deviations in a multicolor rotary printing machine, wherein at least one scanning device, positioned behind the last printing unit, and behind the printing slot, which scans at least one register mark line on the moving printing material in direction of additional section reference marks on the printing material. The section reference marks are designated in this manner, since the reference marks are formed as short line sections.

The section reference marks can be attained with exactly one printing unit, advantageously in the color which is especially or most suitable for the photo-electric receiver in the scanning device. The signals which are generated by the scanning of the register marks, and their section reference marks, are processed together in a circuit arrangement, and wherein the resulting signals derived from the register marks, and the section reference marks are available for determining the register deviations. The invention requires no additional transmitter for transmitting the machine rotary angle, or sensors for scanning of fixed edges on a transport cylinder in order to obtain a reference signal.

It is especially advantageous, for determining the diagonal register deviations, to provide register mark lines on the edge regions of the printing material, which each cooperate with a respective photo-electric scanning device, and to provide respective section reference marks for each register mark line.

A variation of the invention provides that a line of section reference marks is placed next to the respective register mark lines, wherein the line of section reference marks is composed of periodical line section screens, i.e. like steps in a ladder, wherein the line sections are placed at right angles (perpendicular) to the direction of movement of the printing material, and wherein the section reference marks are scanned with an additional photo-electric receiver in the scanning device.

An improvement in image resolution can be attained if a line of section reference marks is placed next to the respective register mark lines, and wherein the section reference marks are arranged as an uninterrupted row of right angle triangles, each having a respective short side of the triangle positioned on an uninterrupted straight line next to each other, and wherein the other short side of the triangle is perpendicular to the moving direction of the printing material, and wherein further the long sides of the triangles are parallel, and the section reference marks are scanned by an additional receiver of the scanning device.

In regard to the investment, it is advantageous if the section reference marks are located within the range of the register mark lines of a group of register marks, either ahead of or behind the register marks. Register mark signals and section reference mark signals can then be scanned by the same receiver of the scanning device. For signal processing, it is then advantageous if the section reference marks and the register mark groups are arranged so that the register mark group of one register mark line are aligned in time with the respective section reference marks on the other side of the printing material, and can be scanned with a respective scanning device for the other side of the printing material.

A further variation of the invention, which is advantageous for the signal processing, provides that the section reference marks are positioned within the respective register mark line, and the section reference marks are provided as equidistant line sections having their sides perpendicular to the moving direction of the printing material, and wherein the register marks from respective printing units are printed between adjacent line sections.

A version of the invention with especially low investment and high speed of signal processing can be attained if the section reference marks are positioned within the respective register mark lines, wherein each individual register mark is precisely located in the other register mark line, wherein the individual register marks and the individual section reference marks are sensed at substantially the same times by the respective scanning device, and the section register mark is formed as a single line section which has two parallel sides (i.e. edges) which are perpendicular to the moving direction of the printing material, and wherein the distance between the edges is exactly equal to the scanning with of the individual register marks, and which can be determined by scanning the individual respective register marks in their nominal positions.

In accordance with the invention, there is provided an apparatus in a multicolor rotary printing machine for determining register deviations, which includes a scanning device disposed behind a print gap of a last printing unit of the printing machine; at least one register mark line disposed on printing material movable relative to the scanning device, wherein the scanning device is directed to the register mark line; a control circuit connected with the scanning device for processing signals from the scanning device, and a measuring, steering and regulating arrangement receiving inputs from the control circuit in operative engagement with registers of the printing machine, and a plurality of section reference marks on the printing material, in alignment with the register mark line within scanning range of the scanning device for correcting the register deviations.

In accordance with another feature the apparatus includes a plurality of register mark lines, each connected with a respective scanning device, and wherein the scanning device is a photo-electric scanning device.

According to still another feature the apparatus includes a plurality of section reference marks arranged equi-distantly along the register mark line, wherein the section reference marks are each formed as a line section disposed perpendicular to the direction of movement of the printing material, and including a photo-electric receiver in the photo-electric scanning device for sensing the section reference marks.

According to an additional feature the apparatus further includes a plurality of section reference marks disposed next to the register mark line, wherein the section reference marks are arranged in the form of an uninterrupted row of right angle triangles, each triangle having a first short side, disposed uninterrupted on a straight line behind each other, a second short side, disposed at right angles to the direction of movement of the printing material, the triangles having respective long sides, disposed in parallel with each other, and including a further photo-electric receiver in the scanning device for scanning the long sides.

The apparatus according to the invention may further include a register mark group of register marks wherein the section reference marks are disposed at the side of the register mark line facing the center of the sheet, ahead of or following a respective group of register marks.

The apparatus can additionally include a first register mark line, and a first register mark group in the first register mark line, a second register mark line, and a second register mark group in the second register mark line, wherein the first register mark group in the first register mark line is sensed by a first scanning device, and wherein the second register mark groups are sensed simultaneously with the first register mark groups by a second scanning device.

According to still another feature the apparatus according to the invention includes section reference marks which are disposed at the inside of the respective register mark lines facing the center of the sheet, the section reference marks including a plurality of individual identical line sections having section edges disposed perpendicular to the direction of movement of the printing material, and wherein the register marks are disposed between mutually facing section reference marks.

According to a concomitant feature the apparatus according to the invention includes that the section reference marks are disposed, respectively, within the register mark lines, wherein the individual register marks of respective register mark lines are disposed exactly within an individual section reference mark of the other register mark line, and wherein the individual register marks and the individual section reference marks are scanned substantially simultaneously by their respective scanning device, wherein each of the section references marks are formed as individual line sections having parallel edges disposed perpendicularly to the direction of movement of the printing material, and wherein the scanning width (B) of each reference mark is exactly equal to the distance (B) between the parallel edges of adjacent register marks, when the respective individual register marks are scanned in their nominal position.

Although the invention is illustrated and described herein as embodied in an arrangement for determining register deviations of a multicolor rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
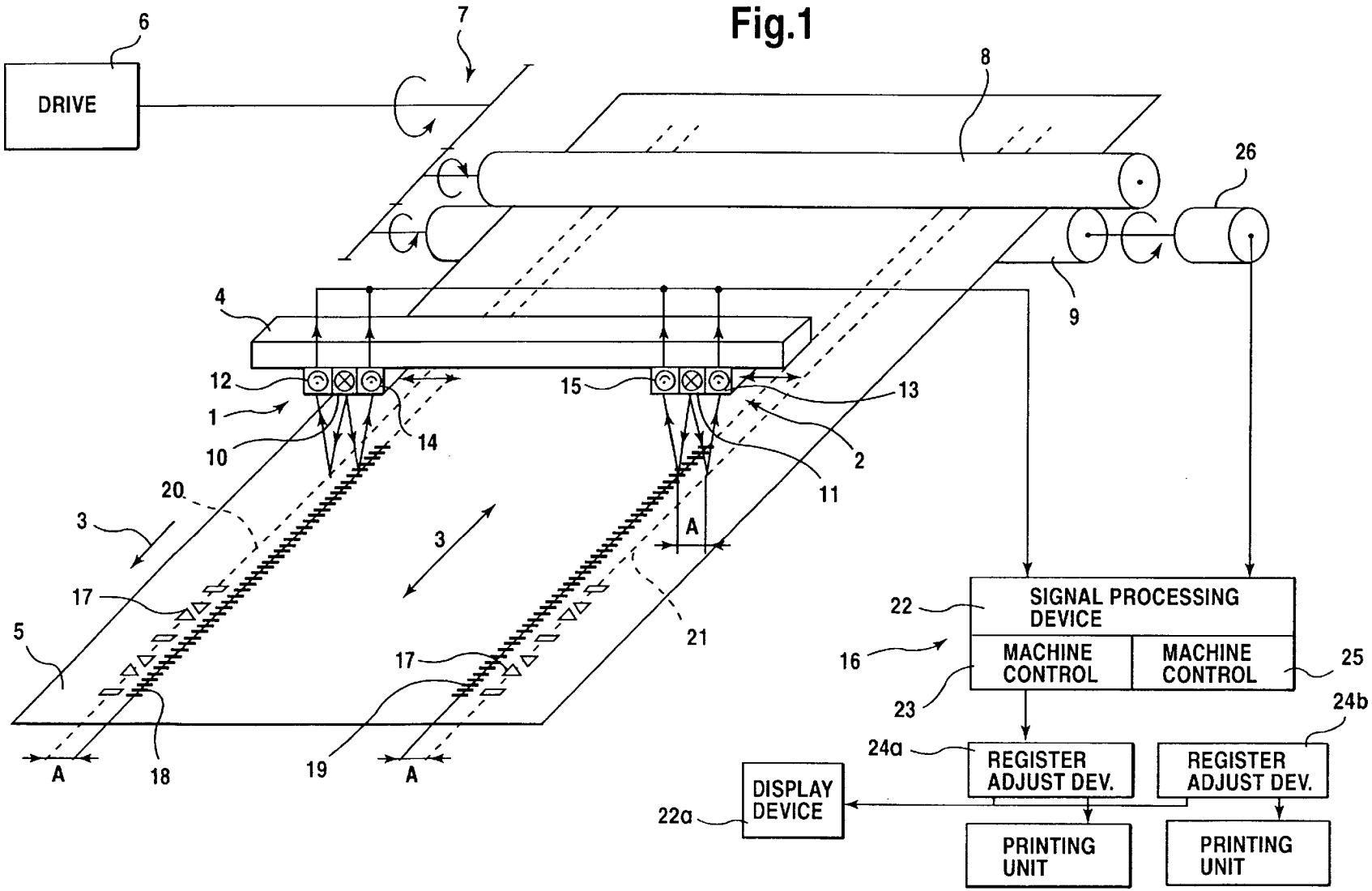
FIG. 1 shows a diagrammatic representation of the invention as applied to printed material moving through a printing machine, and signal processing components connected with register adjusting devices.

FIG. 1 shows in diagrammatic form elements of the apparatus according to the invention. The apparatus accordingly includes, for determining register deviations, two scanning devices 1, 2, which can slide perpendicularly to the sheet move direction indicated by arrow 3 along a cross bar 4. A sheet 5 is driven by a drive 6, via a diagrammatically illustrated gear-wheel transmission 7, and by transport cylinders 8, 9, under scanning devices 1, 2.

The scanning devices 1, 2 contain each a respective common light source 10, 11, a register mark sensor 12, 13, and a section reference mark sensor 14, 15. The register mark sensors 12, 13 and the section reference mark sensors 14, 15 are connected to a machine control arrangement 16 which includes a signal processing device 22, which has printing machine controls 23, 25, which, among other tasks, operate to control register adjusting devices 24 for respective printing machine units (not shown).

In addition to the above-described on-line version of the invention, it is also possible to provide a version of the invention arranged externally to the printing machine. to that end, the sheet 5 is positioned fixedly on a measuring table, and the scanning devices 1, 2 are arranged so that they can move in direction 3 of the sheet 5 in order to determine the register deviations.

In accordance with the invention, the sheet 5 has thereon two lines of section reference marks 18, 19, arranged along respective register mark lines 20, 21, in parallel therewith. The signals generated by the section reference mark sensors 14, 15 and the register mark sensors 12, 13 by scanning of the section reference marks 18, 19 and the register marks 17, are connected to a signal processing device 22 for processing of the register mark signals, which can be part of the aforesaid machine control arrangement 16. Furthermore, the machine control arrangement 16 can include machine controls 23, 25, to each of which is connected a respective register adjusting device 24*a* and 24*b* of the individual printing units of a multicolor rotary printing machine, and a display device 22*a* for displaying the register mark deviations. An incremental angle transmitter 26 connected to a respective printing cylinder 9 of the printing machine is not necessary for obtaining the register deviations according to the present invention. The section reference marks 18, 19 are advantageously printed by a respective printing unit with an ink color that is detected by the respective section register mark sensors 14, 15.

Figure 2:
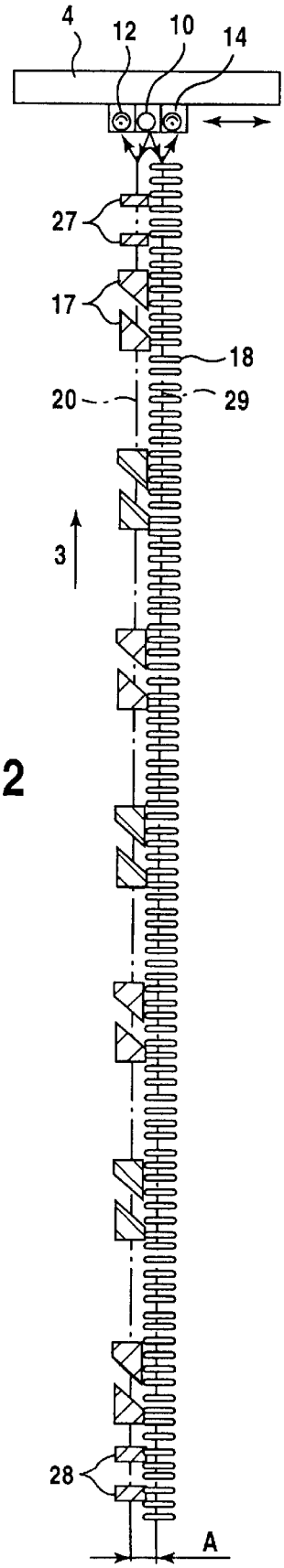
FIG. 2 shows a register mark line with trapezoidal register marks and section reference marks in a periodical line pattern.

In FIG. 2, a register mark line 20 is placed in rows of pair-wise arranged trapezoid-shaped register marks 17, respectively positioned before or behind every two respective pairs of start and end marks 27, 28, printed in the color of the respective printing unit on the sheet 5. Adjacent to this register mark line 20, there is a row of section reference marks 29, which is advantageously printed in the color black, readily detectable by the respective section reference mark sensors 14 and 15. The distance A between the respective mark lines 20 and 21 and the section reference mark lines 18 and 19 corresponds to the distance between the scanning points of the respective register mark sensors 12 and 13 and the respective section reference mark sensors 14 and 15. The reference marks 18, 19 are forming a screen or raster of periodically appearing short line sections, wherein the width of the line sections of the reference marks 18 is equal to the space between the sections of the reference marks 18.

Figure 3:
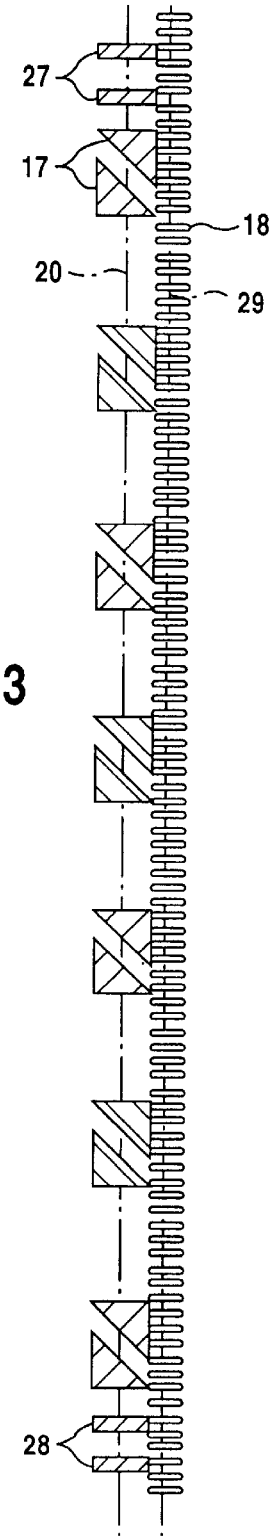
FIG. 3 shows a register mark line with triangular register marks and section reference marks in a periodical line pattern.

FIG. 3 shows the register marks as pairs of triangles 17, wherein each pair of triangles 17 are printed by a respective printing unit. The corresponding section reference mark line 29 is, as in FIG. 2, formed as a line section screen. A high degree of accuracy can be attained by increasing the number of section reference marks 18 per unit of length, and wherein the signal processing device can additionally perform position or speed interpolation of the section reference signals.

Figure 4:
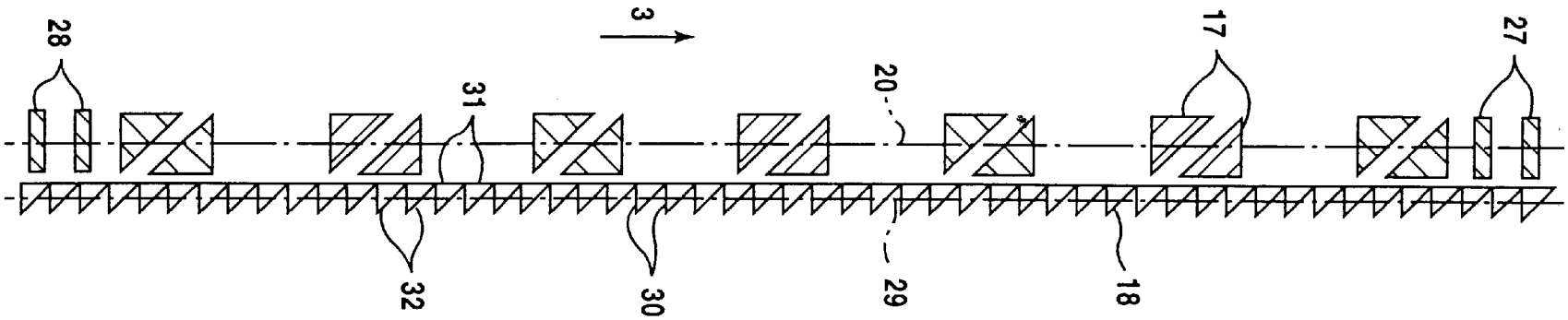
FIG. 4 shows a section reference mark line as a row of right angle triangles.

FIG. 4 shows a version of the section reference marks 18, wherein the section register mark line 20 is an uninterrupted periodic screen formed as a row of right-angle triangles 17. one of the short sides 30 of the triangles is perpendicular to the move direction 3 of the sheet 5. The other short side is positioned in the move direction, and the long sides 32 are all parallel to each other. By arranging the layout of the scanning geometry of the section reference mark sensors 14 to cover the entire width of the section reference mark line 29, the rise time of the scanning signal obtained by scanning the long sides 32 of the triangles, the resolution of the definition of the register marks 17 can be improved.

Figure 5:
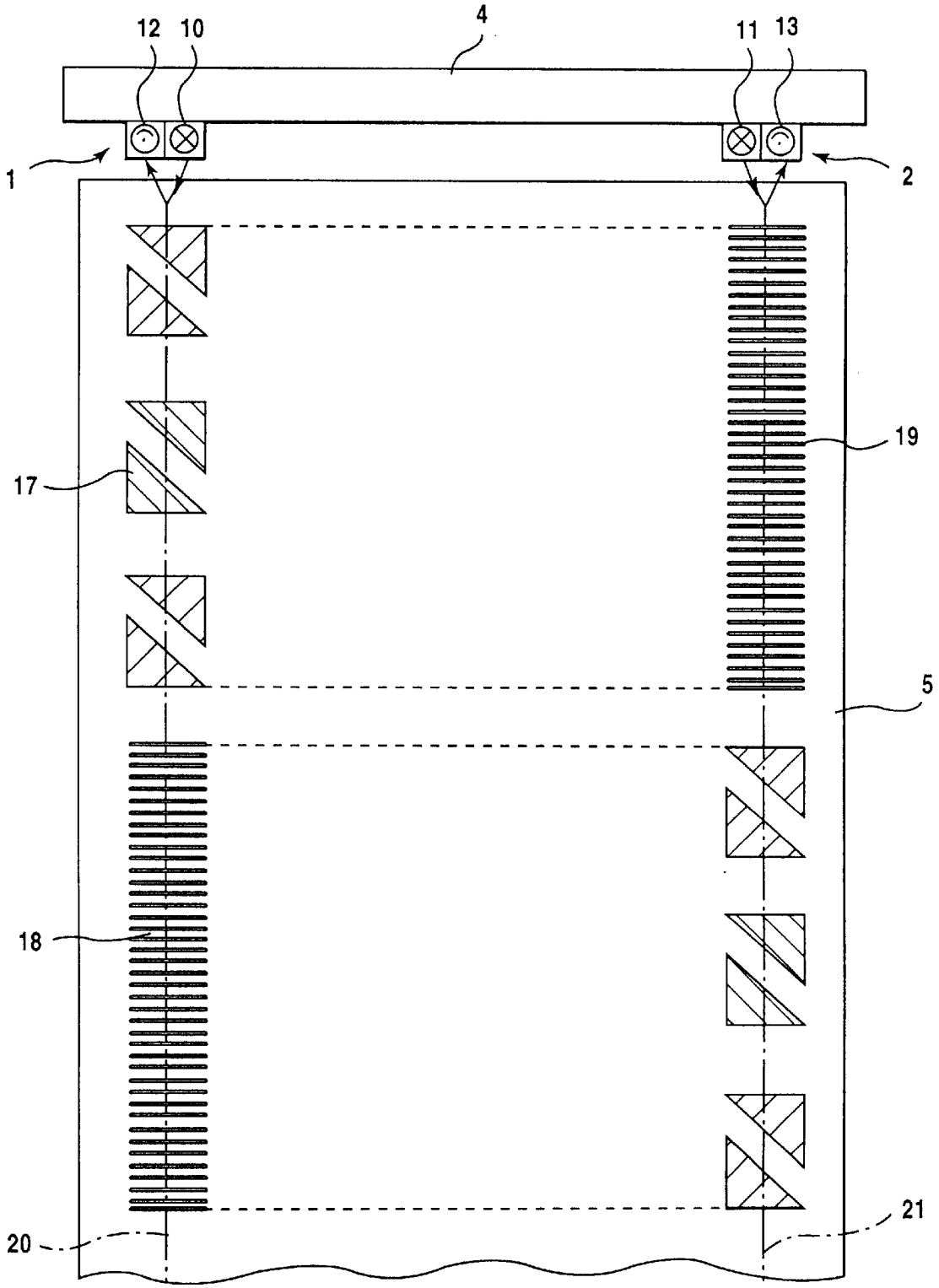
FIG. 5 shows arrangements of register marks and section reference marks disposed in respective lines, each line in alignment with a respective mark sensor and light source.

In the arrangement shown in FIG. 5, the required investment in the scanning devices 1, 2 is reduced due to placement of the section reference marks 18, 19 within the range of the register mark lines 20, 21. Each scanning device 1, 2 requires then only one photo-electric sensor for each line 20, 21, since the register marks 17 and the section reference marks 18, 19 can accordingly be scanned one after the other in time sequence. In FIG. 5, the register marks 17 and the section reference marks 18, 19 can be printed in both edge regions of the sheet 5, so that the register marks 17 of the register mark line 20 can be scanned simultaneously with the section reference marks 19 of the register mark line 21 by the respective register mark sensors 12, 13, and with the section reference sensors 14, 15.

Figure 6:
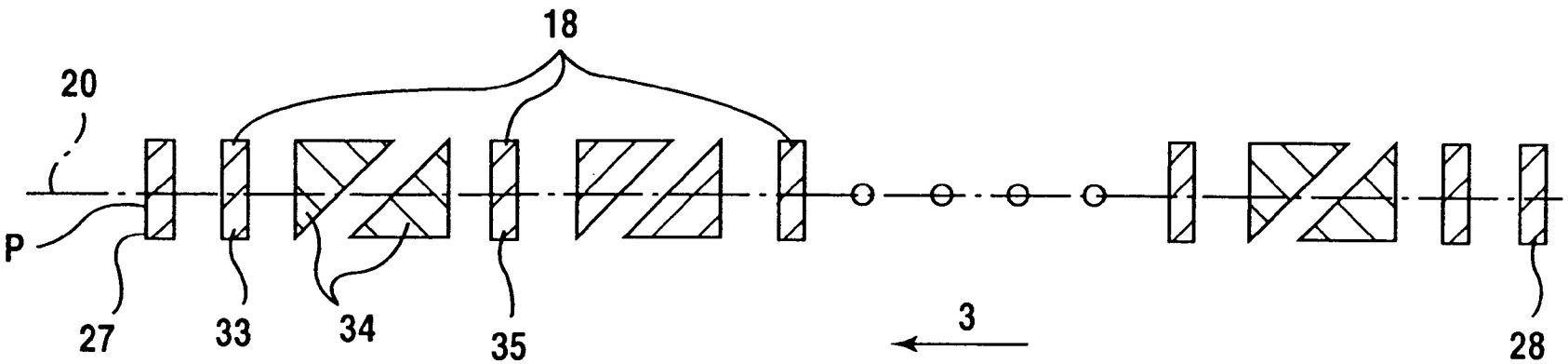
FIG. 6 shows a single line arrangement of register marks and section reference marks formed as line sections.

FIG. 6 shows the section reference marks 18 and the register marks 17 and also the start and end marks 27, 28, similarly arranged along a register mark line 20. The significance of this is that the start mark 27 follows a first individual section reference mark 33 in one color, and that next each pair of triangle-shaped register marks 34 in a certain ink color, each followed by an individual section reference mark 35 printed in the standard ink color. This line 20 ends with the end mark 28. The signals from the individual section reference marks 33, 35 make it possible to perform an interpolation of the velocity of the sheet 5 in respective time intervals between the start mark 28 and the section reference mark 33 respectively between the individual section reference marks 33, 35. Assuming that the velocity variations of the sheet 5 in the range between two individual section reference marks 33, 35 is negligible, it is possible to determine the position of the sheet by measuring its speed from the positions of the register marks 34, and thereby make the necessary register corrections.

Figure 7:
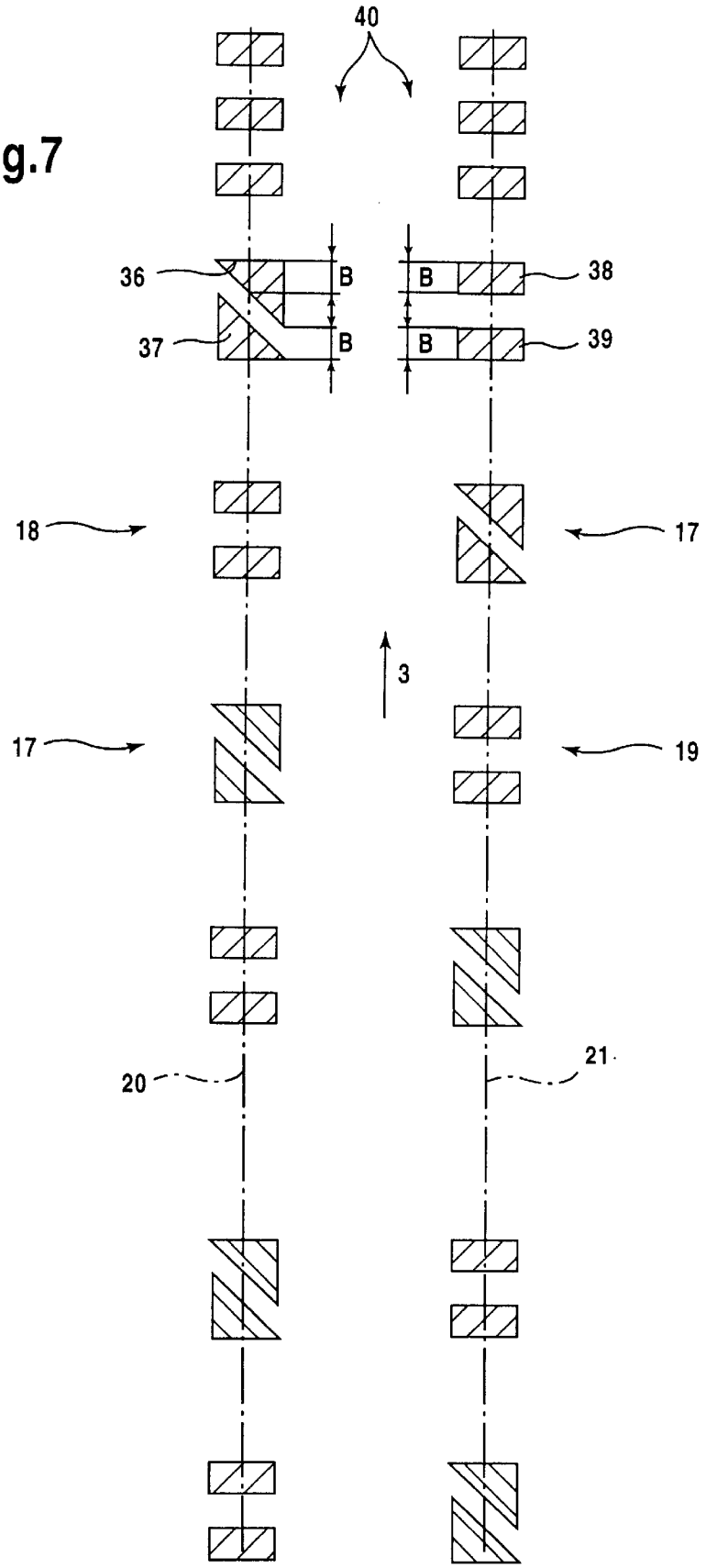
FIG. 7 shows an alternating assignment of register marks each exactly aligned with a respective section reference mark.

FIG. 7 shows a mark configuration wherein the section reference marks 18, 19 are placed along respective register mark lines 20, 21. Each individual register mark 36, 37 of a pair of register marks of a certain ink color of one register mark line 20 performs exactly as a section reference mark 38, 39 in the other register mark line 20, 21. For each ink color there is provided in each register mark line 20, 21 a pair of triangle-shaped register marks 17, and a pair of section reference marks 18, 19 respectively. The individual register marks 36, 37 are scanned at substantially the same time by each respective register mark sensor 12, 13. The section reference mark sensors 14, 15 are scanning the sheet edges in direction perpendicular to the move direction 3 of the sheet 5 at the same sheet latitude except for register deviations. In the exemplary embodiment described, the measures for measurements of the section reference marks 18, 19 and 38, 39 respectively, and their distances from each other are in millimeters. The section reference marks 19 are, as are start marks 40, printed in the particular color printed by the respective printing unit, and are comprised of a single line section having a width of B, whose parallel edges are perpendicular to the move direction 3 of sheet 5. Assuming that a single register mark 36 (or 37) is positioned in its proper position, then it has a scanning width in the direction of move which is also equal to value of B. This version of the invention requires the least investment in regard to scanning devices 1,2 and in the circuit arrangement 22, and offers a high processing speed.

Figure 8:
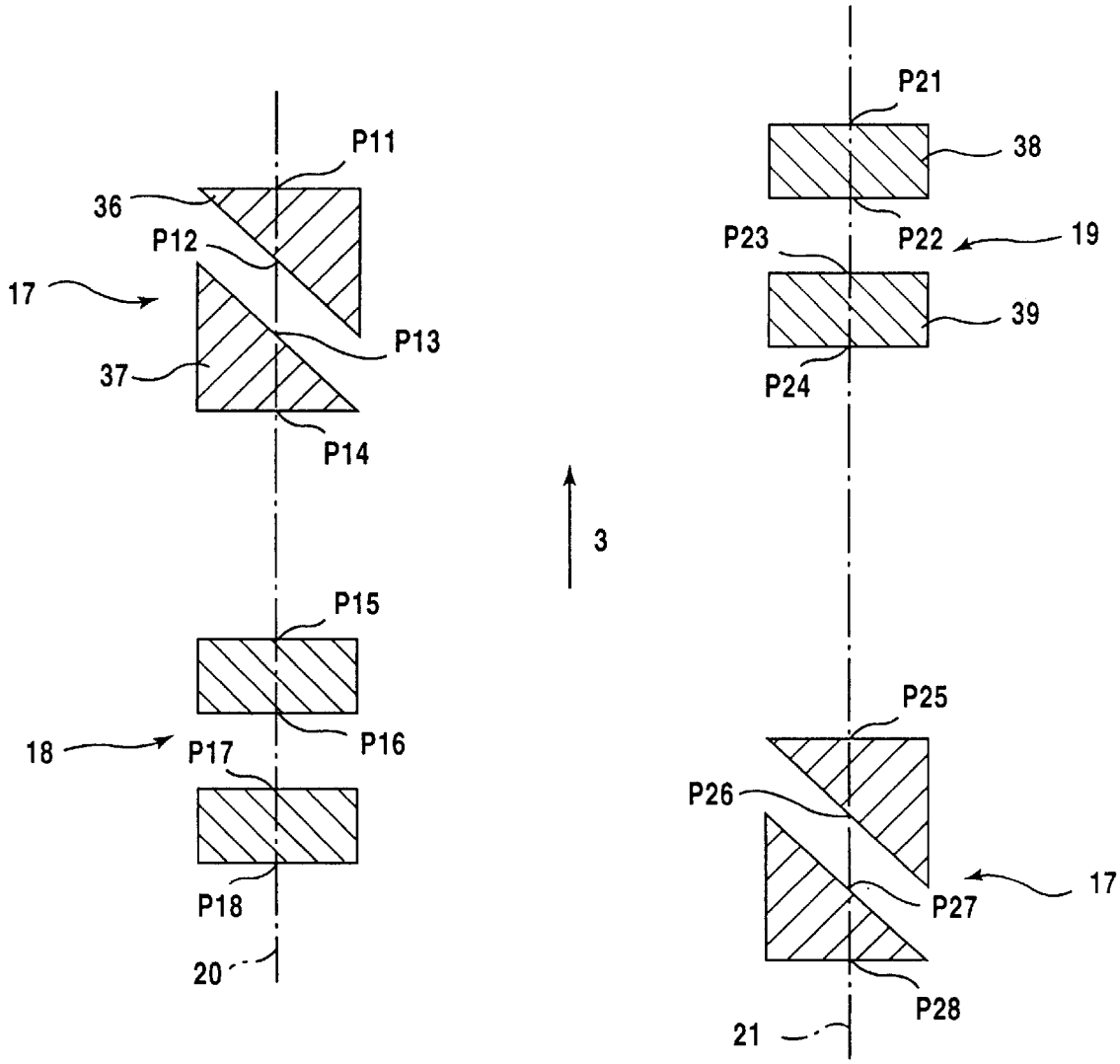
FIG. 8 shows a mark arrangement with respective measuring edges, that are relevant to the measurements.
Figure 9:
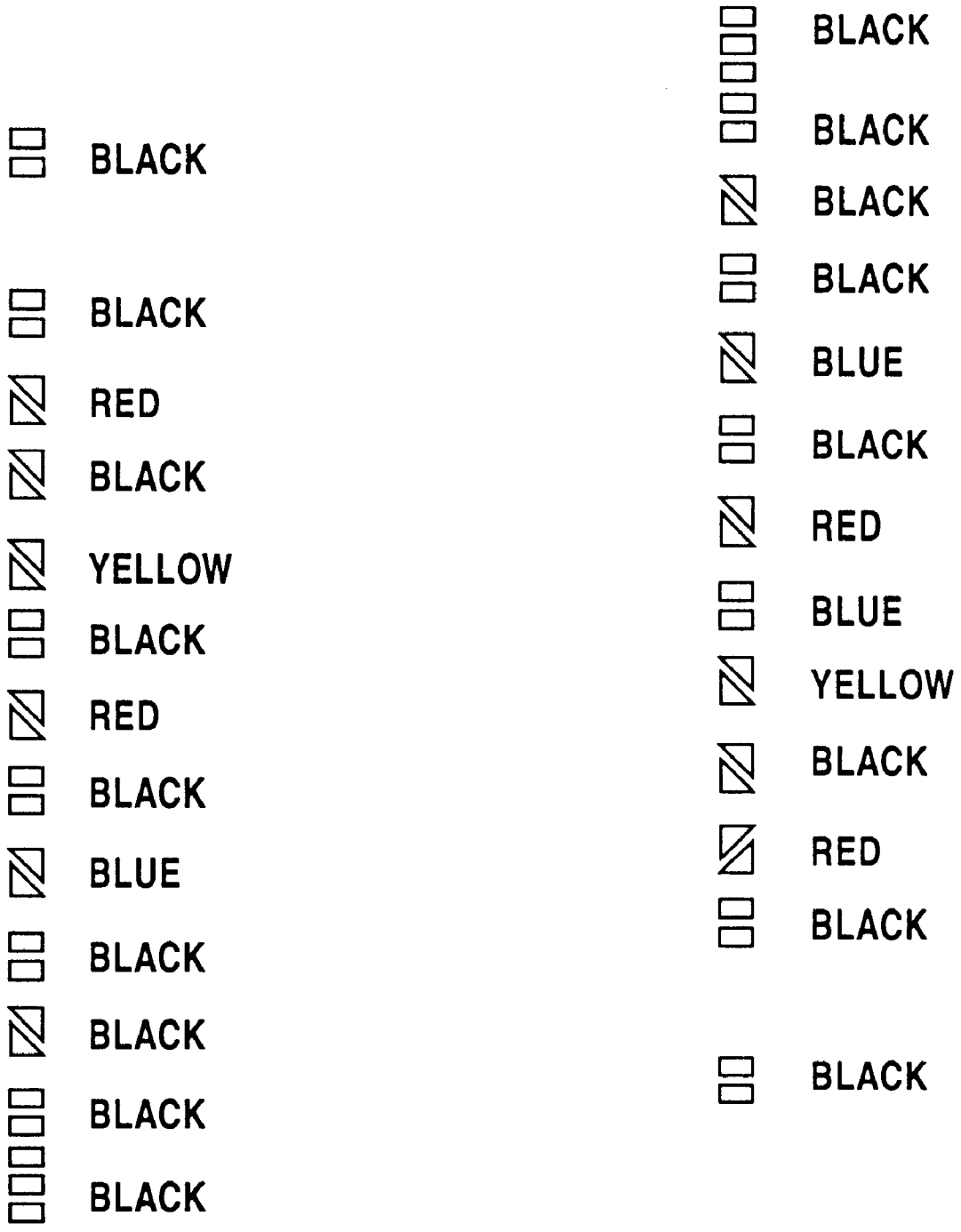
FIG. 9 shows two lines of integrated section reference marks and register marks, with exemplary ink colors from respective printing units designated next the register marks.

FIG. 8 is a fractional view of the mark arrangement according to FIG. 7. The register marks 7 are shown located away from their proper positions. In the following the arrangement of the signal processing as performed by the circuit arrangement 22 will be described by reference to the scanning points designated with a "P—".

In regard to FIG. 6, if the section reference and register marks 33, 34 are printed in their precise registration, then the scanning devices 1, 2 (FIG. 1) will generate identical signal time sequences. Beginning with a leading signal edge P of a start mark 27, high frequency timing pulses generated by a precise quartz crystal generator 51 (FIG. 10) are counted in reference counter 52. The states of counter 52 for the occurrence of each of the edges designated with a "P—" of the register marks 17 in FIG. 8 and the reference register marks 18 or 19 are recorded in a memory, i.e. storage units 56*a*, 56*b*. Next these counter states are processed in a computer (CPU) 53, FIG. 10, which is a part of the signal processing device 22, and register errors, if required, are corrected by the register adjusting devices 24*a*, 24*b* (FIG. 1). The circumferential register deviations $UR_1$ *and* $UR_2$ for register mark lines 20, 21 (FIG. 8) are determined for example as follows:

$$UR_1 = \frac{(P_{11} - P_{21}) + (P_{14} - P_{24})}{2} \quad \text{(a)}$$

and $$UR_2 = \frac{(P_{25} - P_{15}) + (P_{28} - P_{18})}{2} \quad \text{(b)}$$

wherein Pn is equal to the count of timing pulses received in the reference counter 52 (FIG. 10), as described in more detail below, and wherein the subscript n relates to the respective edge of a register mark or reference mark. For example, in equation (a) $P_{11}$ represents the count in counter 52 at the moment the leading edge of register mark 36 is recorded in storage unit 1. An edge detector detects the moment the edge of the mark passes under the respective register mark sensor 1, 2 (FIG. 1).

It follows that in equation (a), the difference $P_{11}$–$P_{21}$ represents the time difference between the passing of the respective leading edge of register mark 36, and the leading edge of reference mark 38, and the difference $P_{14}$–$P_{24}$ represents the time difference between the respective trailing edges of register mark 37 and reference mark 39. As seen in equation (a) the sum of the differences is divided by 2 to give a mean value UR, of the time difference between the respective leading edges and the trailing edges for mark line 20. Equation (b) performs the same operation on mark line 21 to give a means value $UR_2$.

The diagonal register deviation can now be determined as:

$$\text{SchRR} = U_{R2} - U_{R1} \quad \text{(c)}$$

To that end it is necessary that the register mark lines 20,21 are located on the respective edge of the sheet 5.

The side register deviations can be determined by equation (d) as:

$$SR = \frac{((P_{12} - P_{11}) - (P_{22} - P_{21})) + ((P_{24} - P_{23}) - (P_{14} - P_{13}))}{4} + \frac{((P_{26} - P_{25}) - (P_{16} - P_{15})) + ((P_{18} - P_{17}) - (P_{28} - P_{27}))}{4} \quad \text{(d)}$$

The above values indicated by P(I,K) represent the Ith line as determined at the sides of the edges. The advantage of the mark arrangement according to FIGS. 6, 7 and 8 is the complete independence of the determination of the register deviations from changes in the velocity of the sheet 5. While, in the arrangement according to FIGS. 2–5, it must be assumed that the velocity of the sheet 5 is consistent, and determined by the geometry of the respective arrangement of the section reference marks 18, 19, the section length is shortened in the arrangement according to FIGS. 7 and 8, due to their closer approximation to the proper register adjustment. Determination of the register deviations is always more correct, if obtained as the value close to the correct position. Since only the counter states P(I,K) of the respective absolutely necessary edges are stored, the amount of information to be processed is minimal.

It follows that the values from equations (c) and (d) represent counts of pulses from the frequency generator 51, as recorded in storage units 1 and 2 (56*a*, 56*b*). In order to obtain the actual register errors in units of length, the respective counts must be multiplied in the central processing unit 56 by the distance the printing material moves during two counts of the frequency generator 51.

Figure 10:
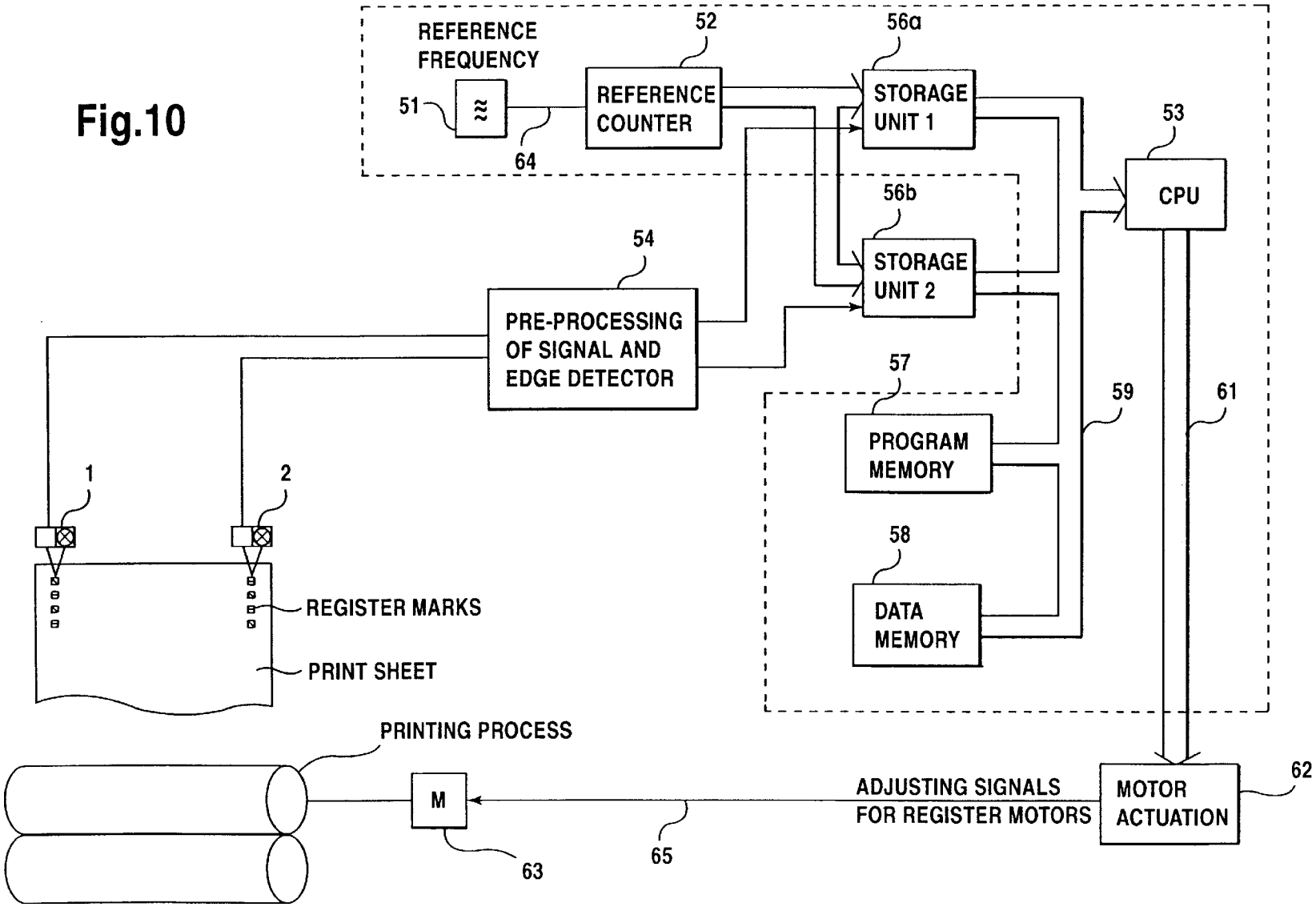
FIG. 10 is a block diagram showing the major blocks of the electronic apparatus of the invention.

In FIG. 10, the reference frequency generator is a very stable and precise pulse generator which generates a precise reference of e.g. one megahertz or any other suitable frequency high enough to define the movement of the printing material in sufficiently small increments as required for determining a high degree of definition of the register deviations. The program memory 57 contains in storage the control program for the CPU 53, which are structured according to the flow charts shown in FIGS. 12*a, b* and *c*, as described in more detail below. The data memory 58 serves to contain fixed and variable data as required for the operation of the CPU 53 in conventional manner.

The data bus 59 operates to transmit data between the various blocks 56*a*, 56*b*, 57, 58 and CPU 53 as required according to the control program. The CPU 53 is connected via an output bus 61 to a motor actuation unit 62, which represents each register motor for each register, i.e. the circumferential, side, and diagonal register motor (M) 63 for each printing unit. Such motors are quite conventional and are well known in the printing art. The motor 63 can, for example, be realized as stepping motors that are set back or forward by step pulses generated by the CPU 53 and transmitted via motor actuation circuit 62 by a bus 65 to each register motor 63 so that any register deviation determined by the CPU 53 is corrected.

Figure 11:
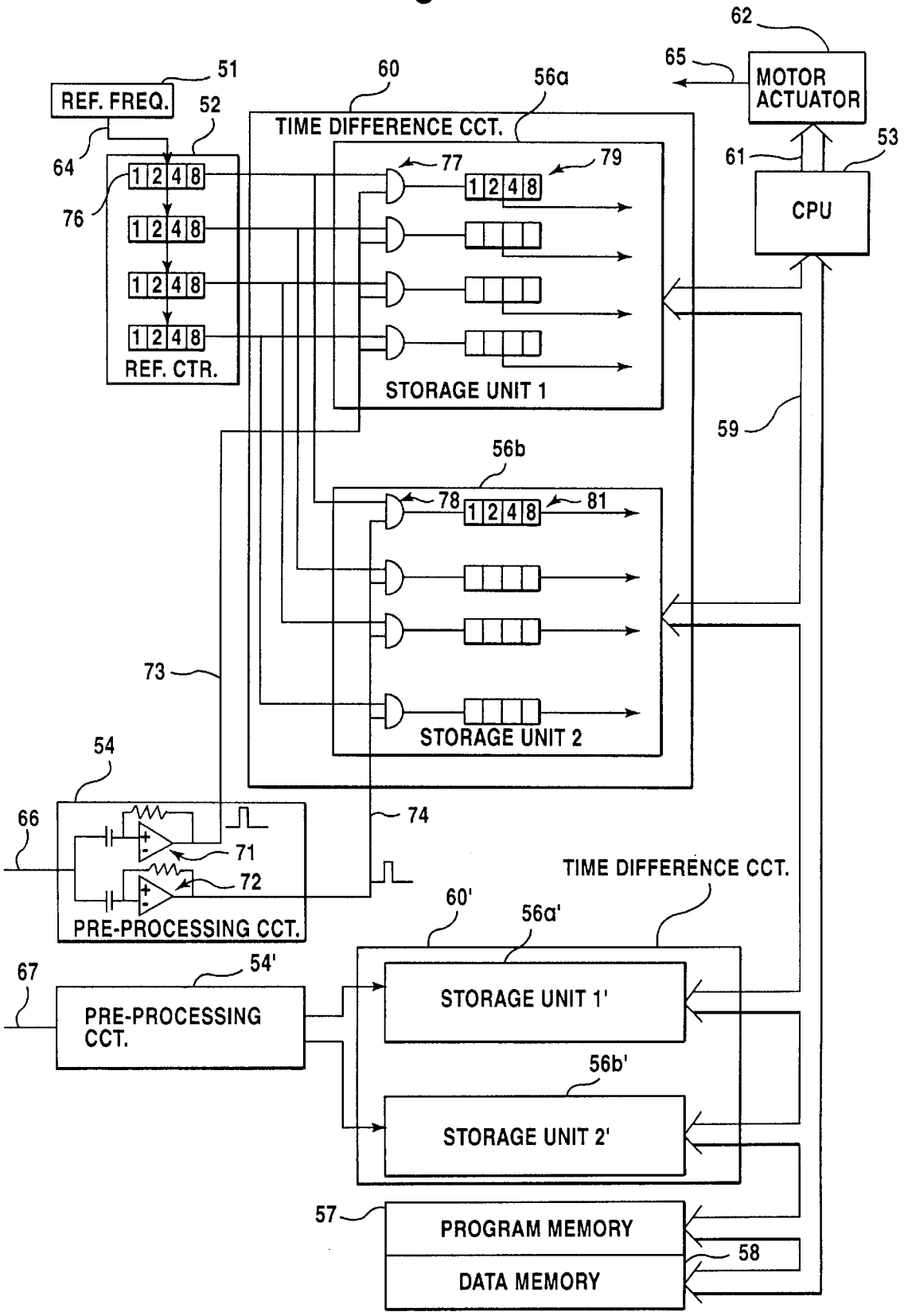
FIG. 11 shows details of the electronic control apparatus according to FIG. 10.

FIG. 11 shows further circuit details of the block diagram shown in FIG. 10.

The pre-processing circuit 54 includes two differentiating circuits 71, 72 of conventional construction, with a common input 66 connected via signal line 66 to optical scanning device 1 (FIG. 1), while pre-processing unit 54' is connected to scanning unit 2 via line 67. When the scanning signal on signal line 66 goes active as a leading edge P11, P13, P15 or P17 (FIG. 8) of a register or reference mark is detected, a positive start pulse is generated on the differentiating circuit's output lead 73, and when subsequently the trailing edge of the mark is detected, a positive end pulse is generated on the output lead 74. The reference frequency circuit 51, described above, drives a continuously running reference counter 52 formed of a counting chain of series-connected counters 76 of conventional construction. In other words, the reference counter 52 is a continuously running clock. A time difference circuit 60 is composed of storage units 1 and 2. The reference counter 52 is coupled to storage units 1 and 2 by means of respective blocks of AND-gates 77, 78. At the moment the leading edge of a register or reference mark is detected the contents of the reference counter of that moment is transferred via AND-gates 77, all being activated simultaneously by the leading edge pulse on line 73, to corresponding registers 79 in storage unit 1. The contents of storage unit 1 is next transmitted via CPU bus 59 to the CPU 53. Similarly, when the trailing edge of the register or reference mark is detected, a trailing edge pulse is transmitted from differentiating circuit 72 via lead 74, which activates AND-gates 78, causing the contents of reference counter 52, at that moment to be transferred into storage registers 81 of storage unit 2. The contents of storage unit 2 is subsequently transferred via CPU bus 59 to CPU 53. The CPU can next compute the time difference between the respective leading and trailing edges of each register and reference mark. It should be noted that counters 76, the AND-gates 77, 78 and storage registers 79, 81 are shown only diagrammatically, and that several conventional details, such as reset functions, couplings 76 and data transfer gates etc. have not been shown in complete detail for the sake of clarity, since such details would be readily provided by a person having ordinary skills in design of electronic circuits.

The corresponding circuits for the other optical scanning device 2 (FIG. 1) are shown in the bottom part of FIG. 11 with the same parts marked with the same reference numerals with a prime, e.g. the pre-processing circuit is shown as box 54', which constructed and operates in the same manner as pre-processing circuit 54. The same remarks apply to storage units 56' and 56*b*', that are part of time difference circuit 60'.

Figure 12A:
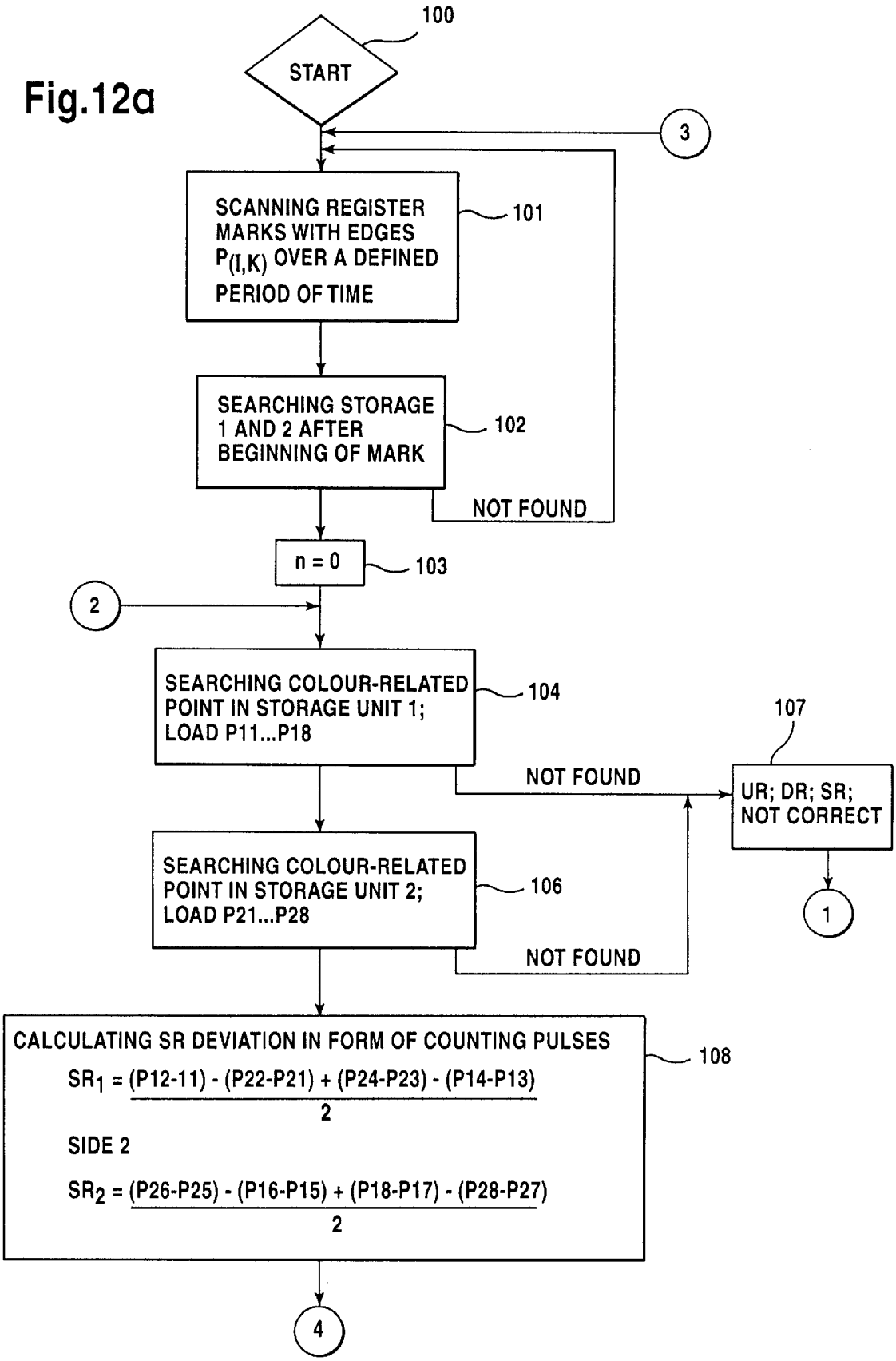
FIGS. 12*a*, 12*b* and 12*c* together show a flowchart of the steps of a method for practicing the invention.
Figure 12B:
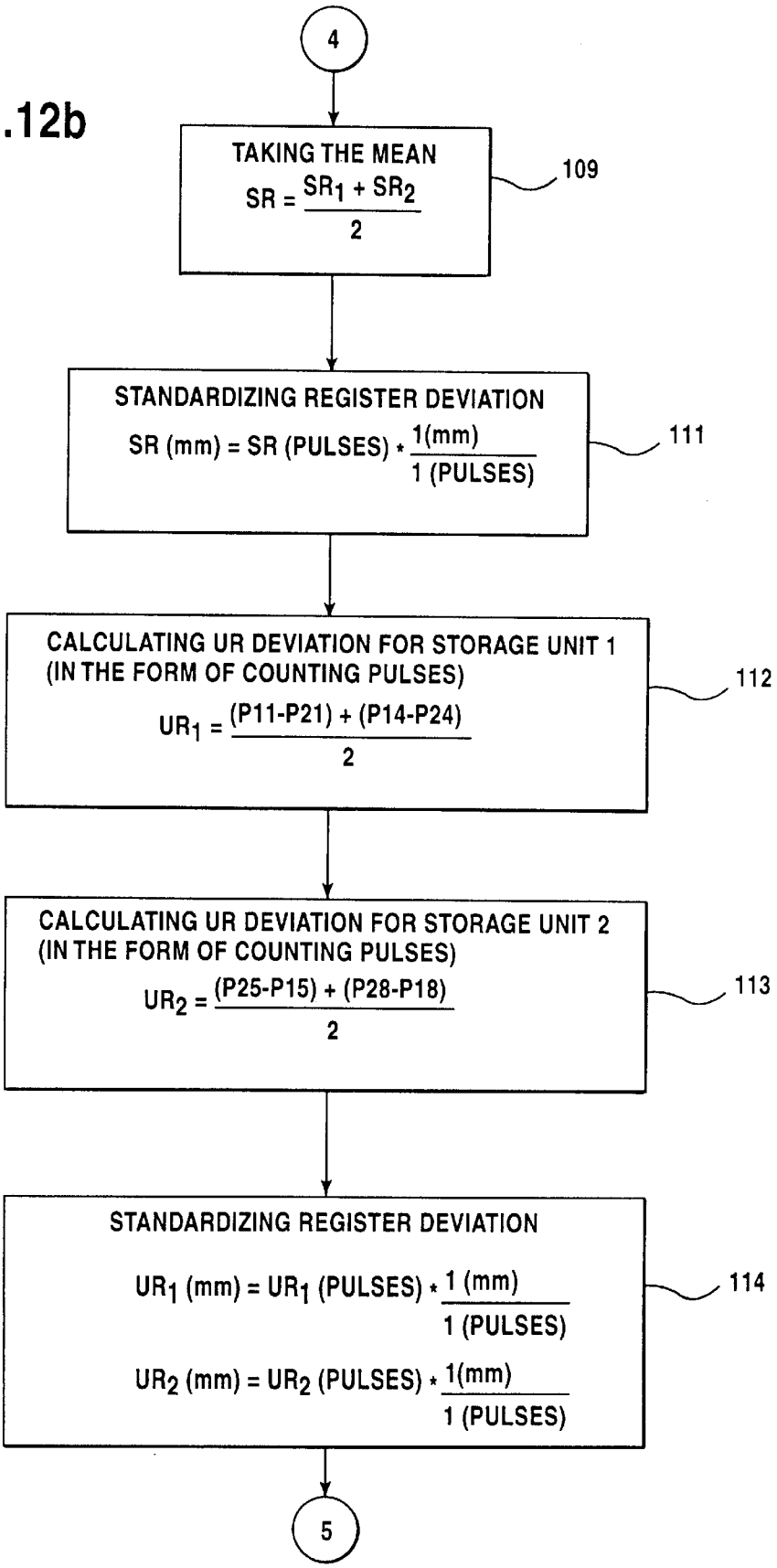
Figure 12C:
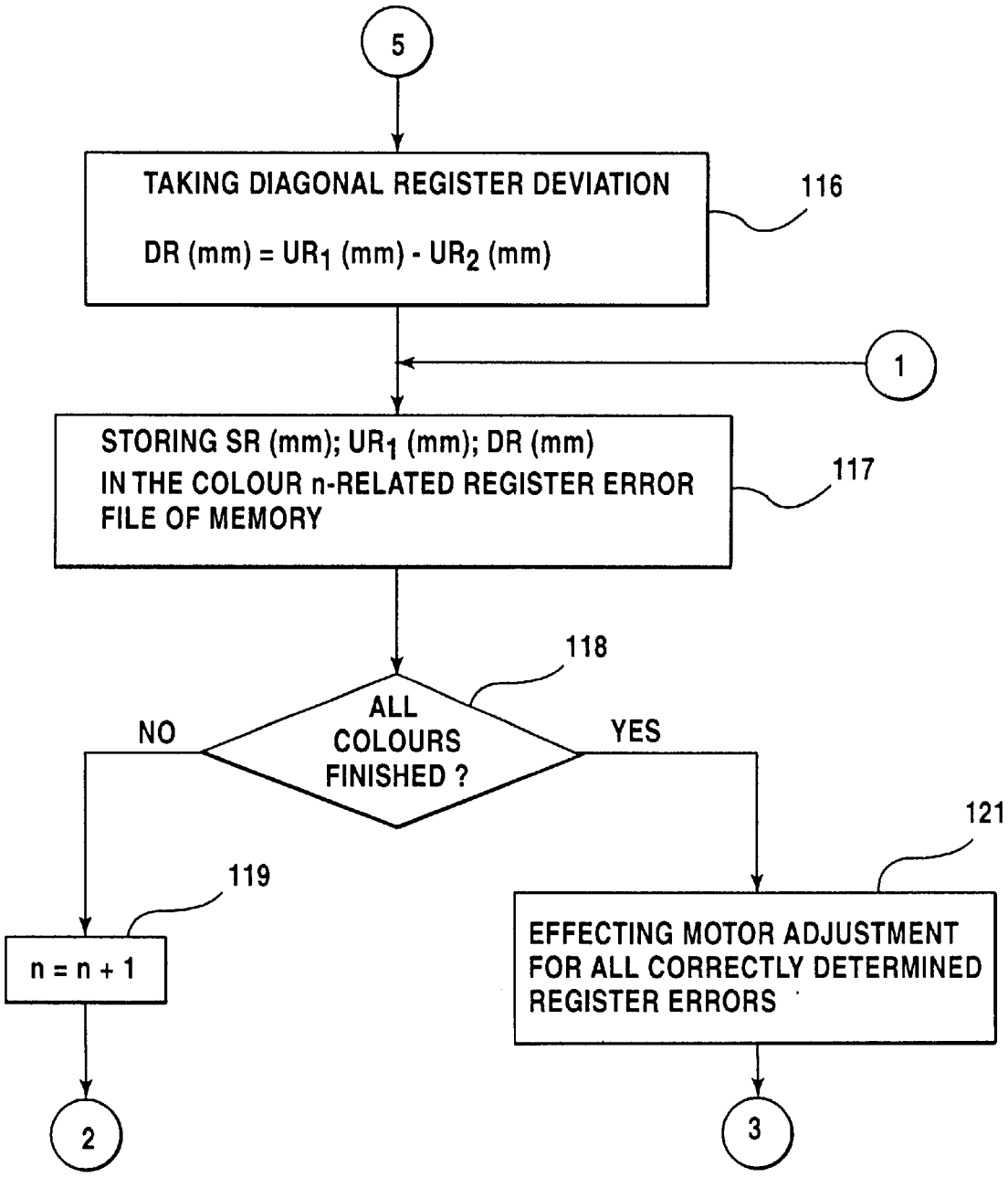

FIGS. 12*a*, 12*b* and 12*c* show a flowchart describing the operation of the CPU in determining the register deviations, i.e. register errors, which are to be connected for the printing units.

The flowchart is described only briefly since the labels in each block are shown in sufficient detail to enable a person having ordinary skills in designing computer programs to provide a complete working program for the operation of the invention. The small numbered circles identify connections to parts of the flowchart shown on other sheets of the flow chart.

After start 100, the register and reference marks are scanned and the leading and trailing edges P(I,K) are timed in steps 101 and 102, until the marked edges for a respective unit are detected. Once a first leading edge is formed, a step counter is set for a first selected color n=O in step 103. In step 104, after the first color is selected, the edges P11–P18 (FIG. 8) for storage unit 1 are searched. If no edges are found, an error or continue message is received in step 107. Next the same color marks are searched in storage unit 2 in step 106, and if not found an error message is again issued in step 107.

When the edges are detected and their times are determined in the side register deviation equations SR1 and SR2, if any, are computed by the CPU in step 108, and the mean side register deviation SR is determined in step 109. In step 111 the register deviations are normalized or standardized, i.e. converted from pulse count deviations to standard register deviations measured in e.g. millimeters in step 111.

In step 112, the circumferential deviation UR1 is computed for storage unit 1, and in step 113 for storage unit 2, and standardized into millimeters in step 114.

In step 116, the diagonal register deviations DR are determined in normalized form as the difference between the respective circumferential register values UR1 and UR2, and next, in step 117, all register deviations in the first selected color are stored in memory of the CPU for subsequent execution, if necessary.

In step 118, a test is made to determine if all colors have been scanned. If the answer is "no", n is incremented by one in step 119, returning the process to step 104, and if the answer is "yes", all register motors are activated to perform the required register corrections in step 121.

What is claimed is:

1. Device for obtaining register deviations in a multi-color rotary printing machine having a plurality of printing units, including a last printing unit having a printing slot, comprising:

an opto-electronic scanning device disposed behind the printing slot of the last printing unit, said opto-electronic scanning device disposed in alignment with a register mark line printed on a printing material, and formed of a plurality of reference marks, and a plurality of register marks, printed in respective colors of the printing units, and wherein said scanning device is operative for generating signals representing edges of the reference marks and the register marks caused by relative movement of the printing material relative to the scanning device;

a signal processing device for processing the edges of the reference marks and register marks connected with said scanning device, for determining as an actual value, for each register mark the time distance of at least one signal edge from a respective signal edge of a reference mark;

wherein the reference marks each have two parallel edges perpendicular to the relative movement of the printing material;

wherein the reference marks are each printed in exactly one color and have a defined distance between adjoining reference marks; and wherein at least one reference mark is disposed between two register marks in close proximity thereto.

2. A device according to claim 1, wherein the reference marks and register marks are printed as identical arrangements at both sides of the printing material for determining diagonal register deviations.

3. Apparatus in a multicolor rotary printing machine having registers, the apparatus operative for determining register deviations, the apparatus comprising a scanning device disposed behind a print gap of a last printing unit of the printing machine; at least one register mark line disposed on printing material movably disposed relative to the scanning device, wherein said scanning device is directed to said register mark line; a control circuit connected with said scanning device for processing signals from said scanning device, steering and regulating apparatus, receiving inputs from said control circuit in operative engagement with registers of said printing machine, and a plurality of reference section marks on said printing material, in alignment with said register mark line within scanning range of said scanning device for correcting said register deviations.

4. Apparatus according to claim 3, including a further register mark line connected with a further respective scanning device, and wherein said scanning device is a photo-electric scanning device.

5. Apparatus according to claim 4, wherein said plurality of section reference marks are arranged equi-distantly along said register mark line, wherein said reference marks are each formed as a line section disposed perpendicular to the direction of movement of said printing material, and including a photo-electric receiver in said photo-electric scanning device for sensing said section reference marks.

6. Apparatus according to claim 4, wherein said plurality of section reference marks are disposed next to said register mark line, wherein said section reference marks are arranged in the form of an uninterrupted row of right angle triangles, each triangle having a first short side, disposed uninterrupted on a straight line behind each other, a second short side, disposed at right angles to the direction of movement of said printing material, said triangles having respective long sides, disposed in parallel with each other, and including a further photo-electric receiver in said scanning device for scanning said long sides.

7. Apparatus according to claim 4, including a register mark group of register marks wherein said section reference marks are disposed at the side of said register mark line facing the center of said sheet, ahead of or following a respective group of register marks.

8. Apparatus according to claim 7, including a first register mark line, and a first register mark group in said first register mark line, a second register mark line, and a second register mark group in said second register mark line, wherein said first register mark group in said first register mark line is sensed by a first scanning device, and wherein said second register mark groups are sensed simultaneously with said first register mark groups by a second scanning device.

9. Apparatus according to claims 4, wherein said section reference marks are disposed at the inside of said respective register mark lines facing the center of said sheet, said section reference marks including a plurality of individual identical line sections each having section edges disposed perpendicular to the direction of movement of said printing material, and wherein said register marks are disposed between mutually facing section reference marks.

10. Apparatus according to claim 4, wherein said section reference marks are disposed on the sides of said respective register mark lines facing the center of said sheet, wherein said individual register marks of the respective register mark lines are disposed exactly within the section reference groups of the other register mark line, and wherein the individual register marks and the individual section reference marks are scanned substantially simultaneously by their respective scanning device, wherein said section reference mark groups include at least a single line section having parallel edges disposed perpendicularly to the direction of movement of said printing material, and wherein the scanning width (B) is exactly equal to the distance (B) between the parallel edges of said line section, wherein said respective individual register marks are being scanned in their proper position.

* * * * *